United States Patent [19]

Dietz

[11] 4,094,569

[45] June 13, 1978

[54] SAFETY CAP SLIDE

[75] Inventor: Ernest W. Dietz, Torrance, Calif.

[73] Assignee: Pacific Electricord Company, Gardena, Calif.

[21] Appl. No.: 794,845

[22] Filed: May 9, 1977

[51] Int. Cl.[2] ..... H01R 13/44

[52] U.S. Cl. ..... 339/40

[58] Field of Search ..... 339/39, 40, 41, 42, 339/36; 174/67

[56] References Cited

U.S. PATENT DOCUMENTS

| | | | |
|---|---|---|---|
| 2,477,803 | 8/1949 | Huber | 339/40 |
| 3,980,371 | 9/1976 | Kahn et al. | 339/40 |

*Primary Examiner*—Neil Abrams

*Attorney, Agent, or Firm*—Fulwider, Patton, Rieber, Lee & Utecht

[57] ABSTRACT

There is disclosed a safety electrical outlet such as a cube tap that is provided with sliding protective plates which overlie the prong-receiving slots of the outlet and are spring-biased to offset positions obstructing direct access to the receiving slots. The invention comprises an improvement over prior constructions in that a single resilient spring is employed to bias a pair of adjacent protective plates thereby greatly facilitating the assembly and reducing manufacturing costs. Additionally, the resilient spring is a spring of simple, bowed configuration which can be quickly and easily inserted in the supporting structure.

7 Claims, 9 Drawing Figures

SAFETY CAP SLIDE

BACKGROUND OF THE INVENTION

1. Field of the Invention

This invention relates to safety electrical outlets and, in particular, relates to cube tabs having protective plate members over the prong-receiving receptacles.

Description of the Prior Art

Increasing concern for child safety has led to recent requirement for cube tabs of electrical cords that all, or all but one, of the prong-receiving receptacles be shielded or obstructed by a cover plate.

A very suitable construction for this application is that described in our prior patent, U.S. Pat. No. 3,980,371.

While the prior patented device is well suited for its protective application, improvements in reduction of manufacturing costs and ease of assembly are desirable. In particular, it is desirable to reduce the number of parts of the assembly and to provide a more facile manufacturing method.

BRIEF DESCRIPTION OF THE INVENTION

This invention comprises a safety electrical connector preferably of the cube tap type which has protective plates that overlie the prong receptacles of the connector. A plurality of prong-receiving receptacles are provided on one face of the electrical connector and a plurality of protective plates are provided, each plate overlying a respective face area of the body which includes respective prong receptacle means. The protective plates have prongreceiving apertures and are slidably mounted on the body, moveable between aligned and misaligned positions with the prong receptacles. A single resilient spring member is mounted in a slot between adjacent protected areas and the spring has distal bowed sections, each of which resiliently biases a respective protective plate into its misaligned position, obstructing its associated prong receptacles of the connector body.

BRIEF DESCRIPTION OF THE DRAWINGS

The invention will be described by reference to the figures of which.

DESCRIPTION OF THE PREFERRRED EMBODIMENTS

Figure 1:
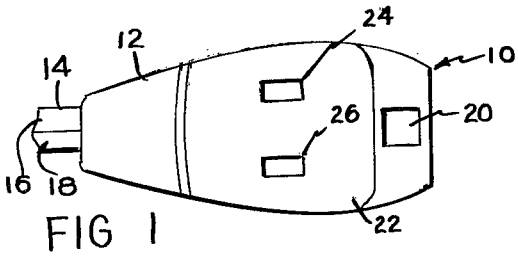
FIG. 1 illustrates the unprotected face of a cube tap of the invention.

Referring to FIG. 1, the invention is shown as applied to a cube tap 10 which comprises a molded body 12 bearing at one end thereof an electrical cord 14 of a plurality of electrical conductors 16 and 18. The body 12 is a typical molded cube tap which has a central longitudinal channel 20 resulting from the molding die.

The cube tap has a face 22 which bears prong receptacle means in the form of a pair of parallel, prong-receiving slots 24 and 26.

Figure 2:
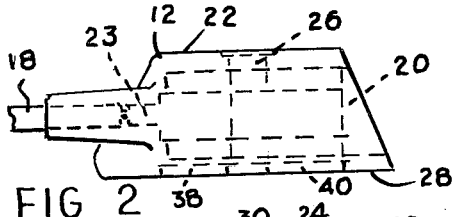
FIG. 2 is a side view of the cube tap.
Figure 4:
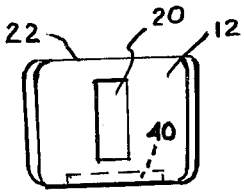
FIG. 4 is an end view of the cube tap of the invention.

Referring now to FIG. 2, each of the electrical conductors such as 18 extend into electrical contact with a pair of parallel, flat contactor strips such as 23 which are molded into the body 12 and which communicate with the prong-receiving, parallel slots such as 24 and 26 to make electrical contact therein with connector prongs received within the slots.

Figure 3:
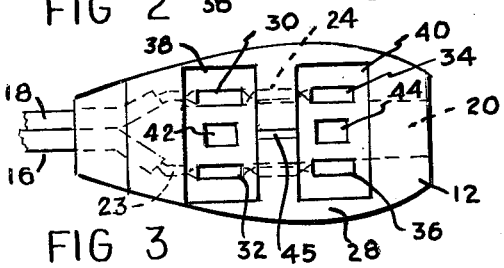
FIG. 3 illustrates the protected face of the cube tap, without the protective plates.

FIG. 3 shows face 28 of body 12. This face is opposite face 22 and is the protected face in that the prong receptacles carried therein are to be covered by protective plates. The protective plates are not in the assembly shown in FIG. 3 and will be described in greater detail hereinafter. The face 28 of body 12 has a plurality of prong receptacles in the form of a first pair of parallel, prong-receiving slots 30 and 32 and a second pair of similar prong-receiving slots 34 and 36.

Each pair of prong-receiving slots is within a respective face area 38 and 40 of the face 28 and these face areas comprise rectangular recessions in body face 28. Each face area 38 and 40 also has a central aperture 42 and 44 disposed between the parallel, spaced-apart prong-receiving slots and this aperture provides open communication to the longitudinal channel 20 within the body 12. A narrow slot 45 is molded into face 28, extending between adjacent face areas 38 and 40.

Figure 5:
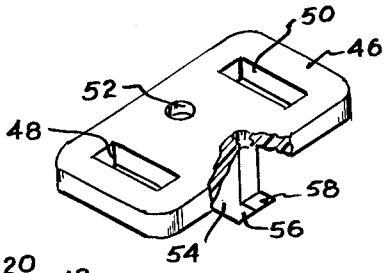
FIG. 5 is a perspective view of a protective plate used in the invention.

Referring now to FIG. 5, the protective plate member employed in the invention will be described. As there illustrated, the protective plate is a generally rectangular plate 46 having a pair of parallel, spaced-apart, prong-receiving apertures 48 and 50. The plate also has a pair of centrally disposed apertures 52 which result from the molding die but serve no other function in the invention. The undersurface of the protective plate bears detent means for obtaining attachment of the plate in the assembly. The detent means comprises a downwardly dependent bracket member 54 having distal, lateral tabs 56 with inclined or bevelled leading edges 58.

Figure 6:
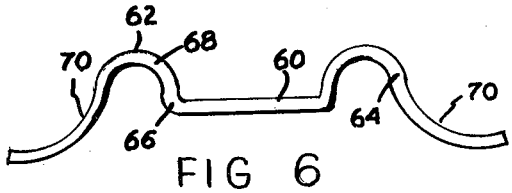
FIG. 6 is a view of a resilient spring used in the invention.

The resilient spring means employed in the invention for biasing a pair of the aforementioned protective plates into their nonaligned, prong-receptacle obstructing positions is shown in FIG. 6. As there illustrated, the spring member is formed of a suitable resilient material, e.g., steel, piano wire, and the like. The member is formed with a straight central section 60 and distal bowed sections 62 and 64. Each bowed section is formed with a right angle arcuate bend 66, a semicircular arcuate bend 68 and a reverse arcuate bend 70.

Figure 7:
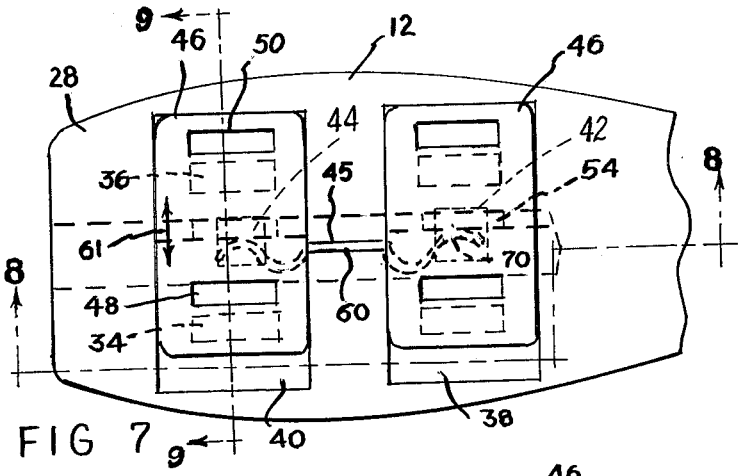
FIG. 7 is a view of the protected face of the cube tap with the protective cover plates in place.
Figure 9:
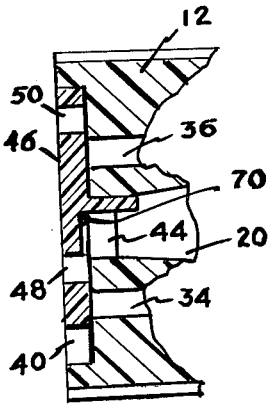
FIG. 9 is a partial sectional view along lines 9—9 of FIG. 7.
Figure 8:
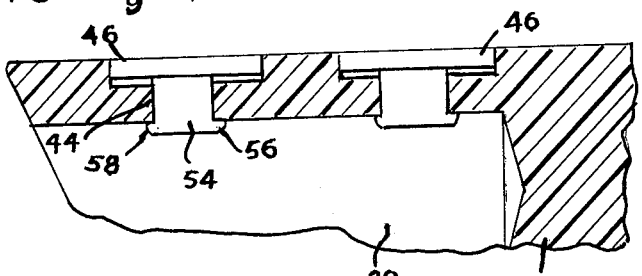
FIG. 8 is a partial sectional view along lines 8—8 of FIG. 7.

The assembly of the body 10, protective plate members 46 and resilient spring previously described is shown in FIGS. 7-9. Referring now to FIG. 7, the protected face 28 of body 12 is illustrated. Each of the recessed face areas 38 and 40 receive a protective plate member 46, slidably received within its respective recession in the body face 28. As illustrated in FIG. 8, the downwardly dependent bracket member 54 on the undersurface of each protective plate 46 projects through the central aperture 44 and the distal lateral tabs 56 project past the upper wall of the longitudinal cavity 20 of body 12 and are retained therein. The bevelled leading edges 58 of the bracket members 54 facilitate the insertion of the bracket members 54 into apertures 44.

Each protective plate 46 is slidably mounted within its respective recession and the bracket 54 is slidably received within aperture 44 so that the protective plate 46 can be moved in the directions indicated by the solid arrowheaded line 61. Such movement will displace the protected plate from the misaligned, prong-receptacle obstructing position shown in FIG. 7 to a position wherein the spaced-apart, parallel receptacle slots 48 and 50 are aligned with the subjacent, equally spaced-apart, parallel prong-receiving slots 36 and 34.

The protective plates 46 are urged into the misaligned position shown in FIG. 7 by the resilient bias of the spring member which is mounted with its central portion 60 received within the narrow slot 45 in face 28 of body 12. In this position, the reverse bowed portions 70 of the resilient spring member are biased against the sides of the downwardly dependent brackets 54 of protective plate members 46.

The invention as thus described offers the advantage of providing a protective safety plate on two adjacent prong receptacle areas of a cube tap with only one resilient means for biasing the protective plates in misalignment with the prong-receiving receptacles. This expedient not only reduces the component parts required in the assembled unit but also greatly reduces the assembly time and complexity since the molded cube tap body such as shown in FIGS. 1–4 readily accepts the resilient spring member shown in FIG. 6 in a first assembly step and, in successive assembly steps, receives the pair of protective plate members 46, completing the assembly of the unit. The positive detenting or locking attachment means of the distal lateral tabs 56 on bracket members 54 of plates 46 insures the integrity of the assembled product, preventing one from defeating the safety features of the invention.

The invention has been described with reference to the illustrated, preferred embodiment thereon. It is not intended that the invention be unduly limited by this description of preferred embodiments. Instead, it is intended that the invention be defined by the means, and their obvious equivalents, set forth in the following claims.

What is claimed is:

1. An electrical connector for receiving a prong type connector plug comprising:

a body bearing, on at least one of its faces, juxtapositioned, prong-receptacle means to receive a plurality of said connector plugs;

contactor strips carried internally of said body for electrical contact with prongs placed in said prong receptacles;

a plurality of protective plates, each overlying a respective face area inclusive of a respective receptacle means and bearing prong-receiving aperture means;

attachment means comprising dependent brackets projecting from the undersurface of said protective plates inwardly into face-central apertures in said body in sliding relationship therein between aligned and misaligned positions with respective prong receptacles;

slot means in said body open to said face and extending beneath and between adjacent face areas; and resilient means for each adjacent pair of face areas comprising a spring having a central section received in said slot means and distal S-bowed sections, each resiliently biasing against the center of a respective bracket to urge a respective plate into its misaligned position.

2. The electrical connector of claim 1 wherein each of said prong receptacle means comprises a pair of parallel, prong-receiving slots.

3. The electrical connector of claim 2 wherein said electrical connector is a cube tap comprising a molded body having, at one end thereof, an electrical cord of a plurality of electrical conductors in electrical contact with respective ones of said contactor strips.

4. The electrical connector of claim 3 wherein said face areas are recessions in said body face.

5. The electrical connector of claim 1 wherein said attachment means includes aperture means in said body face with said brackets carried on the undersurface of each said plate received in respective ones of said aperture means.

6. The electrical connector of claim 5 wherein said body has a central longitudinal cavity open to said body aperture means.

7. The electrical connector of claim 6 wherein said attachment means comprises a bracket plate downwardly dependent from each of said protective plate means and received in a respective body aperture and having distal, lateral projections received in said longitudinal cavity.

* * * * *